United States Patent [19]

Uemura

[11] 4,140,941

[45] Feb. 20, 1979

[54] CATHODE-RAY DISPLAY PANEL

[75] Inventor: Sashiro Uemura, Watarai, Japan

[73] Assignee: ISE Electronics Corporation, Ise, Japan

[21] Appl. No.: 914,332

[22] Filed: Jun. 12, 1978

Related U.S. Application Data

[63] Continuation-in-part of Ser. No. 772,537, Feb. 28, 1977, abandoned.

[30] Foreign Application Priority Data

Mar. 2, 1976 [JP] Japan ..... 51-21797

[51] Int. Cl.[2] ..... H01J 31/50; H01J 63/02; H01J 63/06

[52] U.S. Cl. ..... 313/495; 313/384; 313/466; 313/472

[58] Field of Search ..... 313/384, 466, 472, 495, 313/497

[56] References Cited

U.S. PATENT DOCUMENTS

| | | | |
|---|---|---|---|
| 2,927,234 | 3/1960 | Kazan | 313/384 |
| 3,146,368 | 8/1964 | Fiore et al. | 313/408 |
| 3,483,320 | 12/1969 | Gebel | 313/384 X |
| 3,668,466 | 6/1972 | Shimada | 313/497 X |
| 3,892,995 | 7/1975 | Yamazaki | 313/472 X |

*Primary Examiner*—Palmer C. Demeo
*Attorney, Agent, or Firm*—Schatzel & Hamrick

[57] ABSTRACT

A cathode-ray display panel comprising first and second transparent substrates which constitute an envelope, a transparent electrode arranged on the first transparent substrate, a photoconductive layer arranged on the transparent electrode, a plurality of phosphor members arranged on the photoconductive layer, electrically insulating opaque substances embedded between the phosphor members, at least one cathode electrode for emitting electrons and at least one grid electrode for uniformly distributing the electrons emitted from the cathode electrode onto the phosphor members.

10 Claims, 5 Drawing Figures

FIG.2b
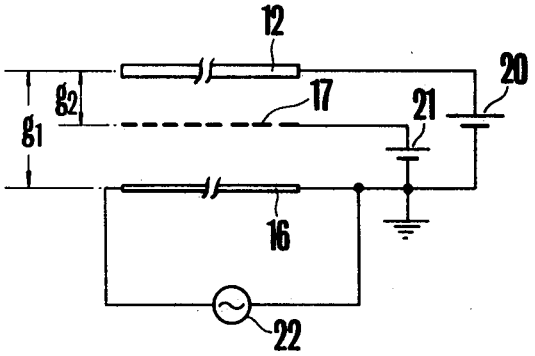
FIG.3a
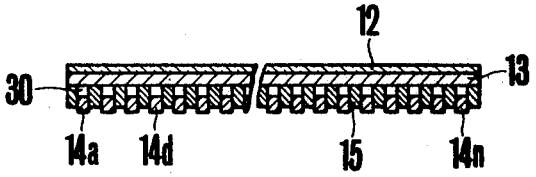
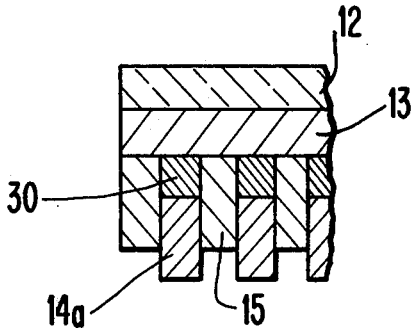
FIG.3b

CATHODE-RAY DISPLAY PANEL

REFERENCE TO OTHER APPLICATIONS

This application is a continuation-in-part of my copending application Ser. No. 772,537, filed Feb. 28, 1977, and now abandoned.

BACKGROUND OF THE INVENTION

1. Field of the Invention

This invention relates generally to cathode-ray display panels and more particularly to a display panel which can operate at a low D.C. voltage.

2. Description of the Prior Art

Various types of display panels have been proposed such as the vacuum photocathode-fluorescent screen type, the electroluminescence-photoconductor type (hereinafter referred to as EL-PC system), the liquid crystal-photoconductor type and so on.

However, the vacuum photocathode-fluorescent screen type has the disadvantages that a high voltage of the order of one or more KV is required, resolution is poor and the cost of manufacturing the photocathode is expensive due to the difficulty of obtaining a good quality photocathode, evey though operated with a D.C. voltage. The EL-PC type, has the disadvantages that an A.C. voltage must be applied in order to cause the EL material to luminesce, photoconductive material resistive to high voltage must be used because the applied voltage is relatively high (an order of 100V), the thickness of the photoconductive layer must be 100 μm or more, the structure of the panel is complicated due to the wire grid electrode and the intensity of luminescence is low. The liquid crystal-photoconductor type has the disadvantages that the liquid crystal is damged by X-rays or ultraviolet rays and that the system requires external light, since the liquid crystal itself does not luminesce and thus its use in the dark is not possible.

SUMMARY OF THE PRESENT INVENTION

Accordingly, it is an object of this invention to provide a cathode-ray display panel capable of being operated with a low D.C. voltage. A more specific object of this invention is to provide a novel cathode-ray display panel having high resolution as well as high intensity of luminescence.

According to this invention, these objects can be attained by providing a cathode-ray display panel comprising first and second transparent substrates which constitute an envelope, a transparent electrode arranged on the first transparent substrate, a photoconductive layer arranged on the transparent electrode, a plurality of phosphor members arranged on the photoconductive layer, an electrically insulating opaque substance embedded between the phosphor members, at least one cathode electrode for emitting electrons and at least one grid electrode or an auxiliary electrode for uniformly distributing electrons emitted by the cathode onto the phosphor members.

IN THE DRAWING

This invention can be more fully understood from the following detailed description taken in conduction with the accompanying drawings, in which:

FIG. 1 is a perspective view, partly in section, showing one embodiment of the cathode-ray display panel according to this invention;

FIG. 2*a* is a sectional view of the cathode-ray display panel shown in FIG. 1;

FIG. 2*b* is a diagram illustrating positional and electrical relation between the electrodes;

FIG. 3*a* is a sectional view showing a layer structure of another embodiment of this invention; and FIG. 3*b* is an enlargement of the left portion of the layer structure shown in FIG. 3*a*.

DETAILED DESCRIPTION OF THE PREFERRED EMBODIMENTS

Figure 1:
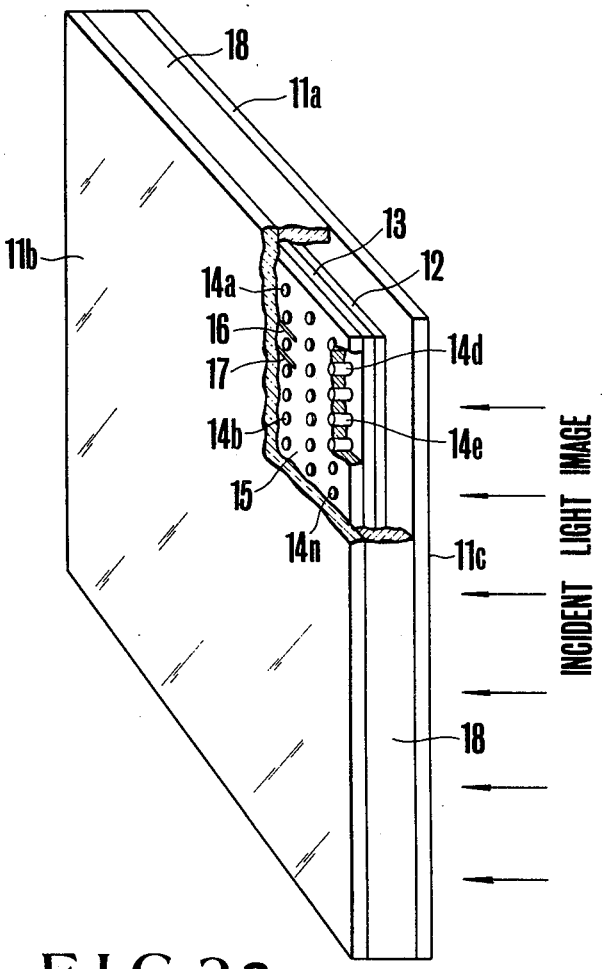
Figure 2A:
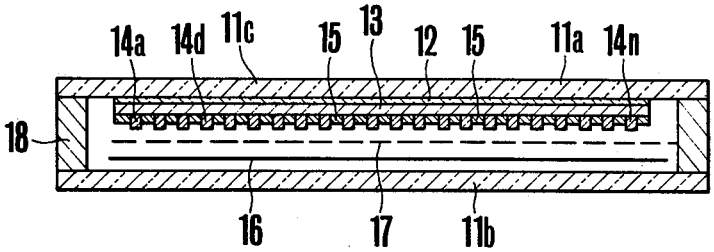

As shown in FIGS. 1 and 2*a*, a cathode-ray display panel in accordance with the present invention comprises a pair of transparent substrates 11*a* and 11*b*, such as those made of glass, which constitute an envelope, a transparent electrode 12 made of material such as SnOx, Sb or $In_2O_3$ arranged on transparent substrate 11*a*, a photoconductive layer 13 arranged on transparent electrode 12, a plurality of phosphor members 14*a* through 14*n* made of ZnO, for example, disposed on photoconductive layer 13, an electrically insulating opaque substance 15 arranged between phosphor members 14*a* through 14*n* for the purpose of preventing crosstalk or leakage between the phosphor members so as to improve the resolution of an image, one or more cathode electrodes 16 dependent upon the size of the device such as a thermionic cathode or a cold cathode electron emitter, one or more grid electrodes or auxiliary electrodes dependent upon the device size for accelerating and homogeneously distributing the electrons emitted from cathode electrode 16 and a spacer 18.

Transparent substrates 11*a* and 11*b* are sealed in airtight fashion to spacer 18, and an inner-space defined by these elements is evacuated to the order of $10^{-6}$ Torr. Cathode electrode 16 and auxiliary electrode 17 are supported in the evacuated space by appropriate means, not shown. Furthermore, transparent electrode 12, which is the anode, cathode 16 and auxiliary electrode 17 are each connected to a corresponding external terminal in a manner known in the art. Each of the plurality of phosphor members 14*a* through 14*n* are in the form of a dot, for example, and are formed on photoconductive layer 13 in a matrix arrangement as shown in FIG. 1. The gaps between the dots are filled with electrically insulating substance 15 using a printing or similar technique.

The composition of photoconductive layer 13 and the thickness thereof are determined by whether the device is to be used with infrared rays, visible rays or X-rays.

Typically, semiconductors of groups II-IV, III-IV and IV in the Periodic Table with mother substrates ZnS, CdS, CdSe, ZnSe, Si, Ge, GaAs, PbS, PbO, PbTe, InSb, PbSe, etc., are used. Layer 13 preferably has a thickness of less than 20 μm taking into account the amount of visible-ray absorption by layer 13. For hard X-rays, a thickness of about 100 μm may be chosen for photoconductive layer 13. A material obtained from the process in which a fine powder of silicon carbide SiC is sieved through a sieve with from 4000 to 8000 meshes, mixed with a glass paste and then calcined, is preferably used for opaque substance 15.

According to the present invention, the cathode-ray display pane may be manufactured using a gap $g_1$ between the anode and cathode, and a gap $g_2$ between the anode and the auxiliary electrode, as shown in FIG. 2*b*, of about 2 mm and from 0.5 to 1 mm, respectively. A DC voltage of from 30 to 40 volts such as supplied by a source 20, illustrated in FIG. 2*b* is ample to supply a positive potential to anode 12 with respect to the grounded cathode 16 due to the narrow gap $g_1$. In addition, a D.C. power source such as a source 21 for supplying a positive potential to auxiliary electrode 17 with respect to the grounded cathode may range from 20 to 70 volts. Finally, the voltage of a power source 22 for heating cathode 16, may range from several volts to scores of volts. Thus, according to this invention the display panel can be operated using low voltage sources. In FIG. *2b*, a D.C. static electric field system is shown to illustrate the manner in which auxiliary electrode 17 distributes electrons which are emitted from the cathode electrode. A more homogeneous distribution of electrons will be attained, however, if an electron beam is used which is scanned by means of a high frequency electric field or alternating magnetic field.

Hereinafter, operation of the cathode-ray display panel according to this invention will be described.

In the first instance, an incident light image (light and shade) which is composed of light rays which may be infrared rays, visible rays, ultraviolet rays and X-rays, is used to penetrate transparent substrate 11*a* and transparent electrode 12 to reach photoconductive layer 13. In order to obtain such a light image, several methods are available. For example, incident surface 11*c* of transparent electrode 11*a* may be irradiated by means of parallel light beams which have passed through a negative film to produce an image having variety in brightness by using brightness-modulated light beams focused by an optical lens and scanned over incident surface 11*c*, or by using laser beam spots or X-ray spots which are modulated in their intensity and scanned over incident surface 11*c*.

When so irradiated, the resistance of the irradiated portions of photoconductive layer 13 will decrease causing the potential applied to phosphor dots 14*a* through 14*n* through transparent electrode 12 to vary. Accordingly, when the electrons emitted from cathode electrode 16 move through the grid electrode or auxiliary electrode 17, toward phosphor dots 14*a* through 14*n*. The brightness of the phosphor dots will vary according to the level of the potential applied thereto. In this case, the variation in the brightness is nonlinear (for example, a third power function curve) so that the intensity of the brightness of the display is emphasized.

Furthermore, once phosphors dots 14*a* through 14*n* luminesce, the light from the phosphors dots is fed back to photoconductive layer 13, causing the resistance of the photoconductor to further decrease with the result being that the image is still further intensified. More particularly, where photoconductive layer 13 is sensitive to visible rays, for example, green light, the resistance value of the photoconductive layer will decrease when irradiated with green light and the associated phosphors are allowed to luminesce. Since the light radiated by the phosphors includes the green spectrum, this radiated spectrum further decreases the resistance value of the photoconductive layer 13. Repetition of this process causes the phosphors to continue to luminesce even after the incident light disappears. In other words, the panel may function as a memory device.

Referring to FIG. 3, another embodiment of this invention will be described. This figure depicts an anode layer structure of a portion of the cathode-ray display panel having reference numerals which correspond to those in FIG. *2a*. In the embodiment of FIG. *2a*, phosphor dots 14*a* through 14*n* were attached on the photoconductive layer 13 while, in this embodiment, another layer 30 of an electrically conductive transparent electrode is formed into islands lying between the phosphor dots 14*a*-14*n* and the layer 13. Additionally, the layer of islands 30 may be formed of an electrically conductive and reflective material or an electrically conductive opaque material, likewise arranged between phosphor dots 14*a* through 14*n* and photoconductive layer 13. When layer 30 is formed as the electrically conductive island, it is possible to avoid degradation of the function of the photoconductive layer due to reaction of the oxide, such as ZnO, contained in phosphors with the photoconductive layer by separating the photoconductive layer from the phosphor dots. When an electrically conductive and light reflective material such as an aluminum is used for layer 30, light radiated from the phosphor dots will be reflected forwardly such that the intensity of the light from the phosphor dots will apparently increase. On the other hand, when an opaque and electrically conductive material such as graphite is used for layer 30, the incident light which is irradiated on the photoconductive side and the image formed on the phosphor dots are effectively separated. In this case, as the incident light can reach photoconductive layer 13, the resistance of the irradiated photoconductive layer will decrease to cause the associated phosphor dots to luminesce 25 a result of electrons fed from the cathode.

As a modification, a transparent electrically conductive film for preventing deposition of electric static charge, such as SnO2 film, is arranged on the inner surface of the above-mentioned envelope. It can avoid an unexpected discharge of the electrons accumulated on the inner surface of the envelope which results in an irregular luminescence, namely noise.

While in the above-described embodiments a photoconductive layer is arranged on a plane, it may be arranged in a matrix. Further, the above-mentioned function of distributing electrons will not be impaired even when the grid electrode and the cathode electrode are mounted on substantially the same plane to avoid shading of electrons due to the grid structure.

As has been described in detail, according to this invention the cathode-ray display panel can be operated at low D.C. voltages, providing a highly luminous display panel suitable for photographing.

Furthermore, the highly luminous phosphor dots enable the display panel to be used in a dark room. Also, an X-ray sensitive photoconductive layer may be employed such that the panel may be used for inspection of apparatus for industrial use or an X-ray visible image converter for medical use. In addition, it may be used to make infrared rays visible. Finally, it is suited for use in a peep window on a door with an optical lens.

Thus, it should be understood that many changes and modifications will be obvious to one skilled in the art without departing from the spirit and scope of the invention as defined in the appended claims.

What is claimed is:

1. A cathode-ray display panel comprising:

first and second transparent substrates which constitute an evacuated and sealed envelope for containing an anode layer structure, a plurality of parallel spaced apart cathode electrodes for emitting electrons and a grid electrode for homogeneously distributing the electrons emitted from the cathode electrodes;

said anode layer structure including a transparent electrode, a photoconductive layer arranged on the transparent electrode, a plurality of phosphor members spaced from each other and arranged on the photoconductive layer, an electrically insulating opaque substance embedded between the phosphor members, and a layer member associated with each phosphor member for controlling the interaction between the photoconductive layer and the phosphor member;

said plurality of parallel cathode electrodes each being in the form of a straight wire overlying the anode layer structure with a relatively small spacing therefrom;

said grid electrode being disposed between the cathode electrodes and the anode layer structure with spacings from them.

2. The cathode-ray display panel according to claim 1 wherein said phosphor members take the form of dots which are arranged in a matrix.

3. A cathode-ray display panel according to claim 1 wherein said layer member comprises a transparent electrically conductive layer.

4. A cathode-ray display panel according to claim 1 wherein said layer member comprises an electrically conductive and light reflective layer.

5. A cathode-ray display according to claim 1 wherein said layer member comprises an electrically conductive opaque layer.

6. A cathode-ray display panel comprising:

first and second transparent substrates disposed in spaced apart parallel relationship and joined together at their peripheries to form an evacuated and sealed envelope;

means forming an anode layer structure disposed within said envelope and including, a transparent electrode disposed proximate said first substrate, a photoconductive layer formed on the side of said transparent electrode opposite said first substrate, a plurality of discrete phosphor members disposed in a spaced apart relationship in a predetermined array over said photoconductive layer and separated therefrom by discrete bodies of electrically conductive material for controlling interaction between said photoconductive layer and said phosphor members, and an electrically insulating opaque substance embedded between said phosphor members and between said discrete bodies;

a plurality of electron emitting cathode electrodes, spaced from each other, disposed adjacent said second substrate and in proximate spaced apart relationship with said phosphor members; and a grid electrode disposed between said phosphor members and said cathode electrodes for homogeneously distributing electrons emitted from said cathode electrodes and flowing toward said anode structure.

7. A cathode-ray display panel as recited in claim 6 wherein said discrete bodies are formed of a transparent electrically conductive material.

8. A cathode-ray display panel as recited in claim 6 wherein said discrete bodies are formed of a light reflective electrically conductive material.

9. A cathode-ray display panel as recited in claim 6 wherein said discrete bodies are formed of an opaque electrically conductive material.

10. A cathode-ray display panel as recited in claim 6 wherein said cathode electrodes are comprised of straight wires overlying said anode layer structure.

* * * * *